United States Patent [19]

Sage

[11] 4,020,774

[45] May 3, 1977

[54] APPARATUS FOR MAKING LOOP PILE FABRIC

[75] Inventor: Paul Sage, Lyon, France

[73] Assignee: Verdol S.A., Lyon, France

[22] Filed: June 20, 1975

[21] Appl. No.: 588,994

[30] Foreign Application Priority Data

June 20, 1974 France ..... 74.22549

[52] U.S. Cl. ..... 112/79 A

[51] Int. Cl.[2] ..... D05C 15/32

[58] Field of Search ..... 112/79 A, 79 R, 79 FF, 112/79.5, 78

[56] References Cited

UNITED STATES PATENTS

| | | | |
|---|---|---|---|
| 2,058,101 | 10/1936 | Perry | 112/79 A X |
| 2,417,204 | 3/1947 | Lanz | 112/79 A X |
| 2,965,054 | 12/1960 | Masland | 112/79 A |
| 2,991,738 | 7/1961 | Zenner et al. | 112/79 A |
| 3,006,296 | 10/1961 | Penman | 112/79 A |
| 3,080,837 | 3/1963 | Kaffine et al. | 112/79 A |
| 3,112,717 | 12/1963 | Hamilton et al. | 112/79 A X |

*Primary Examiner*—H. Hampton Hunter
*Attorney, Agent, or Firm*—Dowell & Dowell

[57] ABSTRACT

In a tufting machine for making patterned pile fabric, each thread passes on two successive guiding pulleys horizontally spaced from each other and selectively displaced vertically independently from each other by the hooks of a loom Jacquard. A thread-lowering beater bar is vertically reciprocated between these pulleys in unison with operation of the machine to draw from the supply bobbin a predetermined length of thread for the formation of a pile loop by the corresponding needle of the machine, a unidirectional thread clamping device being provided between the second pulley and the needle to prevent thread being drawn from the needle itself. The length of thread thus fed to the needle at each advancing stroke of the latter thus varies as one or both of the pulleys are raised by the Jacquard. A stationary bar may be disposed at an adjustable height laterally of the pulleys to permit of altering the length of thread fed to the needle when the adjacent pulley is low.

6 Claims, 7 Drawing Figures

APPARATUS FOR MAKING LOOP PILE FABRIC

FIELD OF THE INVENTION

This invention relates to tufting machines for making patterned loop pile fabrics and it more particularly concerns a device to selectively feed to the needles of such machines variable lengths of thread to realize loops of different height in accordance with the pattern desired.

BACKGROUND OF THE INVENTION

In the U.S. copending application, Ser. No. 547,151 which was filed on Feb. 5, 1975 in the name of Paul Neyraud and is assigned to the assignee of the present invention, machines of the type in question are described which include means for controlling the thread tension, that is the feeding of each thread or group of threads, in such a manner as to permit the making of a boucle fabric, or loop pile fabric, in which the loops are formed with as many as four different loop heights. The described device comprises an assembly of cylinders and a roller capable of being brought into contact to pinch the threads against them for the purpose of imparting to the threads more or less tension. Such systems, although functioning in a perfectly satisfactory manner, are however complex and rather uneconomic.

The improvements which comprise the object of the present invention seek to remedy the drawbacks of the prior art, and to provide a device for feeding thread which is especially useful on tufting machines for making patterned loop pile fabrics, which device performs particularly well by providing various practical advantages.

THE INVENTION

According to the invention in a tufting machine for making patterned pile fabrics, the thread feeding device comprises two horizontally spaced thread-guiding pulleys attached to the cords of a loom Jacquard, preferably of the Verdol type as shown in U.S. Pat. No. 3,871,412 to Servillat, the thread passing on these pulleys in its travel between the supply bobbin and the corresponding needle, while between these pulleys there is disposed a vertically reciprocating thread-lowering beater bar which operates in unison with the machine. It will be apparent that, depending upon the vertical position of the cords, the movement of the beater bar when it descends determines the length of the different threads, and these lengths will be taken up as loops by the machine when the beater bar retreats upwardly. According to a preferred embodiment, an additional horizontal bar is placed on the machine extending lengthwise across to the cords, the bar being adjustable in height so as to make possible a further modification of the length of feed of the thread as determined by its adjusted position.

The following discussion presented by way of illustration provides a better understanding of the invention, its characteristics, and the advantages which it provides.

THE DRAWINGS

Figure 1:
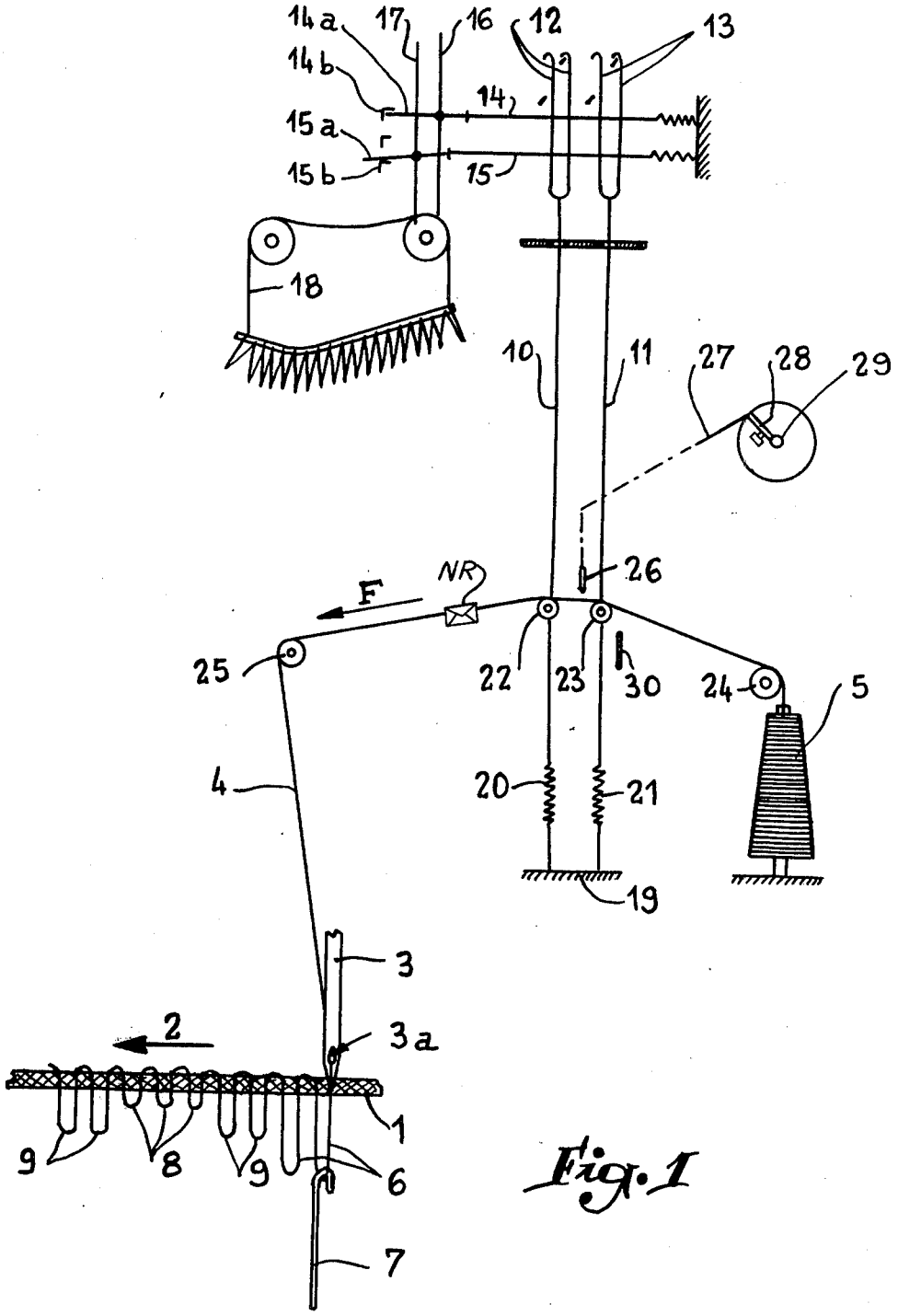

FIG. 1 is a schematic side view illustrating a loom Jacquard of the Verdol type, the cords of which actuate the thread-guiding pulleys of a device according to the invention associated to a tufting machine; and FIGS. 2 through 6 are diagrammatic illustrations showing the device in different positions for feeding thread.

Figure 7:
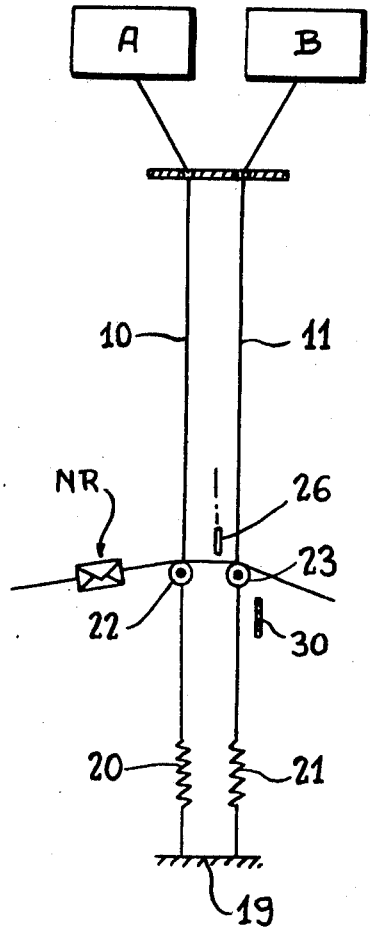

FIG. 7 diagrammatically illustrates a modification.

The following will review briefly the method of making fabric of the loop pile or tuft variety.

The machine illustrated diagrammatically in FIG. 1 forms loops on one side of a relatively heavy fabric 1. The manner in which these loops are formed is shown in the figure wherein the fabric is moved intermittently in the direction of the arrow 2 by means not shown in the drawing. Needles 3 are driven through the fabric each time it is motionless, the needle having an eye **3*a* through which the thread 4 passes as it is drawn from a supply bobbin 5. When a needle 3 pierces the fabric 1 it carries with it the thread 4 to form a loop 6 which is retained by a hook 7 during the upward stroke of the needle, driven by a prior art mechanism not illustrated in the drawing. The fabric is then displaced through one increment of motion; the hook 7 is then disengaged from the previously formed loop 6; whereupon the needle 3 is again driven through the fabric to form the next loop. Depending upon the magnitude of the available length of the thread 4, upstream of the needle the loop 6 retains a particular height. For instance if during the next stroke of the needle 3 the length of the thread 4 which the needle may draw from the supply bobbin 5 is insufficient, some additional thread will be pulled from the last formed loop 6** the height of which will therefore be decreased.

A tufting machine for making loop pile fabric comprises a large number of fabric piercing needles situated side by side which are actuated by an appropriate mechanism so that they are moved up and down in unison. For each needle there is provided a supply bobbin 5 from which the thread 4 is drawn which forms the loops. Opposite each needle there is a set of two cords 10 and 11, respectively coupled to hooks 12 and 13 of a loom Jacquard of the Verdol type provided with vertically movable griffe frames. Thus, the machine comprises two parallel rows of cords, each of these rows being composed of as many cords as there are thread needles 3. In a manner already known, each hook 12 or 13 is displaced horizontally by a Jacquard needle 14 or 15 controlled by a rocking pusher **14*a* or 15*a* adapted to be selectively driven by pusher grid members 14*b* or 15*b* under the control of a feeler needle 16 or 17, selected in turn by a perforated paper 18. The cords 10 and 11 are secured to the machine bed 19 by means of springs 20 and 21,** respectively.

Each of the cords 10 and 11 is provided with a horizontal pin on which is mounted a freely rotatable thread-guiding grooved pulley 22 or 23 over which the thread 4 passes in travelling between the feed rollers 24 and 25 located on one side and the other of the aforementioned rows of cords. Between the two rows there is located a horizontal thread-lowering beater bar 26 taking the form of a narrow edge, having a rounded lower edge, whose length is longer than the width of the machine and which is joined, for example, to an actuating system comprising an arm 27 and crank 28, joined to a control shaft 29 of the machine in such a manner as to reciprocate the beater bar 26 vertically back and forth in appropriate slides (not shown). The amplitude of motion can obviously be varied by changing the effective length of the crank 28, as for instance by realizing the said arm under telescopic form. Arranged parallel to the beater bar 26 and to the warp cord 11 there is located outside of the latter an adjustable stationary bar whose position with respect to the machine bed 19 can be selectively fixed.

The operation set forth hereinafter explains the proceeding structure.

Figure 2:
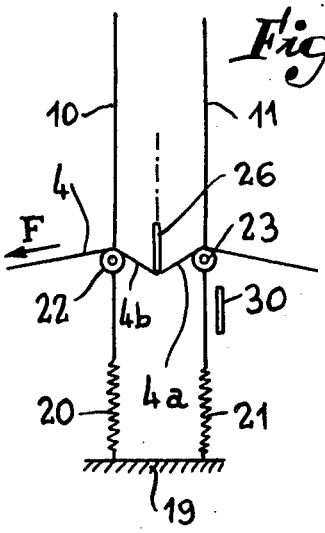
Figure 3:
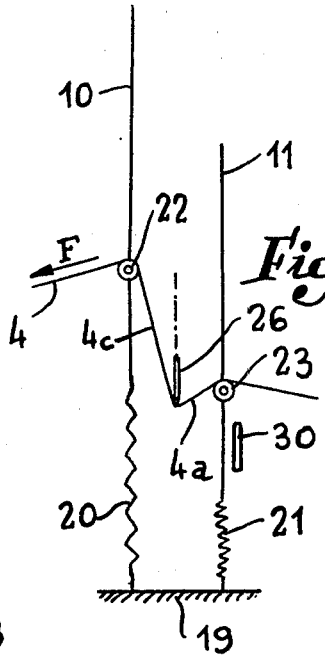

When the hooks 12 and 13 of the two rows are in their lowered position, as shown in FIGS. 1 and 2, the thread 4 passes over the top of each of the pulleys 22 and 23 which are located practically at the same horizontal level with respect to each other. When the thread-lowering beater bar 26 descends to the position as shown in FIG. 2 it withdraws from the supply bobbin 5 a certain length of thread as predetermined, depressed in the form of a V by the bar 26 which descends between the pulleys 22 and 23. The length of the thread which is pulled forth is equal to the difference between the sum of the lengths of the two branches 4*a* and 4*b* of the V-shape and of the separation between the pulleys 22 and 23. In order to displace a greater length of thread by the descent of the beater arm 26, the hook 12 is raised by the ascending griffe frame of the Jacquard to raise in turn the thread-guiding pulley 22 while stretching the spring 20, as is schematically illustrated in FIG. 3. The length of the thread which is pulled off is greater than that which is pulled as a result of the operation as illustrated in FIG. 2 because the branch 4*c* of the V is much longer.

It is obvious that the same result would have been obtained by raising the pulley 23 instead of the pulley 22, since the hooks 12 and 13 have the same vertical stroke.

Figure 4:
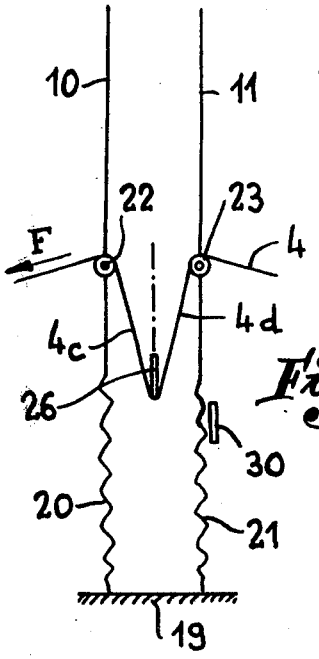

As shown in FIG. 4, the hooks 12 and 13 and the corresponding cords 10 and 11 together with the pulleys 22 and 23 have been raised up as shown in FIG. 4 so much that the length of the thread drawn from the bobbin 5 is again increased over that which was obtained according to the positions illustrated in FIGS. 2 and 3, whereby the two branches 4*c* and 4*d* of the V-shape which are obtained by the action of the beater bar 26 are about twice as long as those of the V-shaped branch in FIG. 3.

Figure 5:
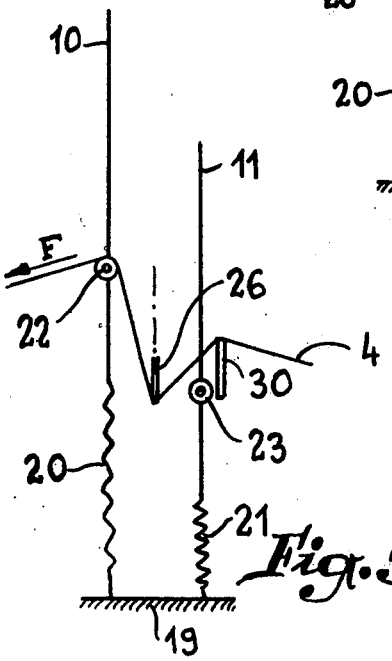
Figure 6:
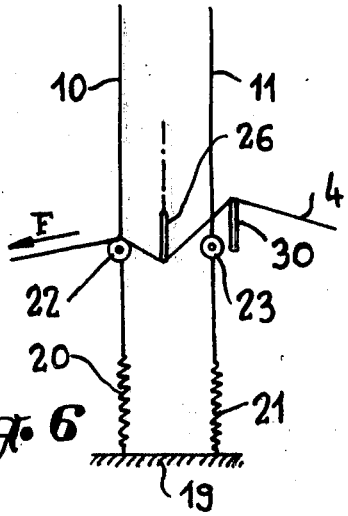

In order to increase the length of thread pulled from the bobbin 5 when the pulley 23 is at its lower position, one can raise the bar 30 as shown in FIGS. 5 and 6, above the lower position of the pulleys 22 and 23, this position being capable of adjustment in order to obtain exactly the desired length of thread pulled from the bobbin 5 which is proportional to the height of the loops 6, 8 and 9 of the fabric which is in the process of being made. Likewise, if the bar 30 is placed below the lowest position of the pulleys 22 and 23 its effect is eliminated as shown in FIGS. 1 through 4. The length of thread pulled out by the descent of the beater bar 26 is immediately taken up by the machine in proportion to the length of stroke of the latter. It is of course assumed that the thread passes through a non-return device diagrammatically indicated at NR in FIG. 1 which is of well known nature, so that it can only be pulled in the direction of the arrow F.

It is also apparent that by adjusting the radial length of the crank 28 it is possible to vary the lengths of the loops obtained as discussed above.

It should be understood that if the hooks 12 and 13 are associated with two different loom Jacquards it is possible to obtain different vertical motions for each of the cords 10 and 11, thereby obtaining still other lengths of loops. It is clear, considering FIG. 3, that if the pulley 23 is raised while the pulley 22 remains at its lower position, and if the vertical strokes of the cords 10 and 11 are different, the length of thread drawn from the supply bobbin 5 will also be different from what is obtained in FIG. 3. Such a modification has been very diagrammatically illustrated in FIG. 7 wherein the Jacquards are referenced A and B.

The description given above was given only for the purpose of illustration and that it does not limit in any way the breadth of the invention or prevent replacement of specific details as set forth with other equivalents.

I claim:

1. In a tufting machine having loop-forming needles, a device to selectively feed to each one of said needles a variable length of thread to realize a pile fabric formed of loops of different height in accordance with a predetermined pattern, comprising:

a thread supply from which thread may be drawn;

a first and a second thread guiding means on which the thread from said supply passes in succession before reaching said one of said needles, said first and second thread-guiding means being spaced from each other in the horizontal direction and including means for vertically displacing the same independently from each other;

a substantially horizontal thread-lowering beater bar vertically reciprocatable between said first and second thread-guiding means to lower the portion of said thread comprised between same;

means to reciprocate said beater bar in unison with the operation of said tufting machine;

unidirectional thread clamping means through which said thread passes between said thread-guiding means and said one of said needles, said unidirectional means only permitting said thread to advance towards said one of said needles;

and Jacquard means to selectively raise and lower each of said first and second thread-guiding means in accordance with the pattern desired for said pile fabric.

2. In a device as claimed in claim 1, said reciprocating means being adjustable to control the stroke of said thread-lowering beater bar.

3. In a device as claimed in claim 1, said thread-guiding means being in the form of pulleys.

4. A device as claimed in claim 1, further comprising a stationary bar disposed parallel to said thread-lowering beater bar outside the vertical space comprised between said first and second thread-guiding means, and adjacent one of said last-named means, means for adjusting said stationary bar in vertical position and having an upper edge to slidably engage said thread when said adjacent one of said thread-guiding means is low.

5. In a device as claimed in claim 1, said Jacquard means being in the form of a single loom Jacquard.

6. In a device as claimed in claim 1, said Jacquard means including a first and a second loom Jacquard to respectively actuate said first and second thread-guiding means, with said first and second loom Jacquards having different vertical strokes.

* * * * *